United States Patent [19]

Sloan, Jr.

[11] 4,362,971

[45] Dec. 7, 1982

[54] POWER SUPPLY FOR ARC DISCHARGE DEVICES

[76] Inventor: Hiram C. Sloan, Jr., 5116 W. 190th St., Torrance, Calif. 90503

[21] Appl. No.: 100,869

[22] Filed: Dec. 6, 1979

Related U.S. Application Data

[63] Continuation of Ser. No. 865,900, Dec. 30, 1977, abandoned.

[51] Int. Cl.[3] ..... H05B 41/39

[52] U.S. Cl. ..... 315/176; 307/2; 307/73; 315/86; 315/170; 315/173; 315/174; 315/244; 315/DIG. 5

[58] Field of Search ..... 315/86, 170, 172–174, 315/176, 244, DIG. 2, DIG. 5, DIG. 7, 166; 307/2–5, 73, 75

[56] References Cited

U.S. PATENT DOCUMENTS

| | | | |
|---|---|---|---|
| 2,892,125 | 6/1959 | Warner et al. | 315/176 X |
| 3,084,283 | 4/1963 | Grunwaldt | 315/DIG. 7 |
| 3,170,084 | 2/1965 | Retzer | 315/174 |
| 3,566,186 | 2/1971 | Woolsey | 315/160 |
| 3,624,447 | 11/1971 | Young et al. | 315/176 X |
| 3,836,815 | 9/1974 | Herzog | 307/73 X |
| 4,009,416 | 2/1977 | Lowther | 315/176 |
| 4,057,750 | 11/1977 | Elms et al. | 315/86 |
| 4,117,373 | 9/1978 | Alley | 315/86 |
| 4,119,887 | 10/1978 | Iyama et al. | 315/DIG. 5 |
| 4,158,792 | 6/1979 | Kuroi et al. | 315/DIG. 2 |
| 4,187,448 | 2/1980 | Kuroi et al. | 315/176 |

*Primary Examiner*—Eugene La Roche
*Attorney, Agent, or Firm*—McDougall, Hersh & Scott

[57] ABSTRACT

This application discloses circuits for use with arc discharge devices wherein a D.C. or A.C. high frequency, high voltage source is provided in conjunction with either a low frequency or D.C. voltage source. The high frequency, high voltage circuit is a low power circuit providing sufficient voltage to ionize the arc. If desired the low power circuit may also control the major arc power obtained from the low frequency or D.C. source which does not require a ballast. By virtue of this arrangement much smaller, lighter and lower cost circuits than conventional ballast circuits can be used.

24 Claims, 12 Drawing Figures

POWER SUPPLY FOR ARC DISCHARGE DEVICES

This is a continuation of application Ser. No. 865,900, filed Dec. 30, 1977, abandoned.

BACKGROUND OF THE INVENTION

This invention relates generally to circuits for supplying power to arc discharge circuits. More specifically, it relates to improvements in circuits utilizing ballasts as current limiting devices in such circuits.

The art has long known of the use of ballasts in circuits for supplying power to arc discharge devices such as arc furnaces and lamps, including flourescent lamps. An essential electrical characteristic of such devices is the need to provide a high starting or ionization voltage and then a lower voltage sufficient to maintain the arc or current flow. After ionization has been achieved, if the voltage is not reduced then current flow will increase unless it is limited in some way for the device itself exhibits what are referred to as negative resistance properties. If the current is not limited it will increase and unstable operation will result and there may be damage to the device.

The necessary current limiting in arc discharge devices has been provided by arc ballasts. If the power supply is D.C. then the ballast is usually a resistor in series between the device and the source. When the source is A.C. the ballast usually includes a substantial reactance. In either case the ballast is relatively large and costly, constituting a significant percentage of the cost of the circuit. Further, inasmuch as the ballast, in order to serve its purpose, is highly reactive at the supply frequency the circuit is relatively inefficient due to the losses in the ballast.

Therefore, it is an object of this invention to provide a novel power supply circuit for arc discharge devices which is smaller, lighter and, therefore, less costly than ballasts used in the prior art.

It is a further object of this invention to provide a novel power supply circuit for arc discharge devices which is electrically more efficient than those of the prior art.

It is another object of this invention to provide a novel power supply circuit in which the arc current can be controlled to eliminate the ballast, for dimming the light intensity, and for reducing electromagnetic interference of ballasts used in the prior art.

It is another object of this invention to provide a novel power supply circuit which can provide emergency lighting or power by the addition of a battery and simple circuit.

It is another object of this invention to provide a novel power supply circuit which may be made in a number of different physical forms embodied in the novel concepts of the invention.

SUMMARY OF THE INVENTION

Briefly, the invention contemplates the provision of two voltage sources, both capable of supplying power to an arc discharge device. The first source is a relatively low voltage source which will conduct current in an arc after ionization has occurred in the device. The second source is a relatively high voltage source which in combination with the first source will ionize the device. After ionization both sources supply current to the arc discharge. When the second source is removed, the current from the first source will gradually decay to zero. After ionization the second source may be used to control the magnitude of current from the first source.

BRIEF DESCRIPTION OF THE DRAWINGS

The invention itself is set forth in the claims appended hereto and forming a part of this specification, and an understanding of various embodiments thereof may be had by reference to the following detailed description taken in conjunction with the drawings in which:

DETAILED DESCRIPTION

Figure 1:
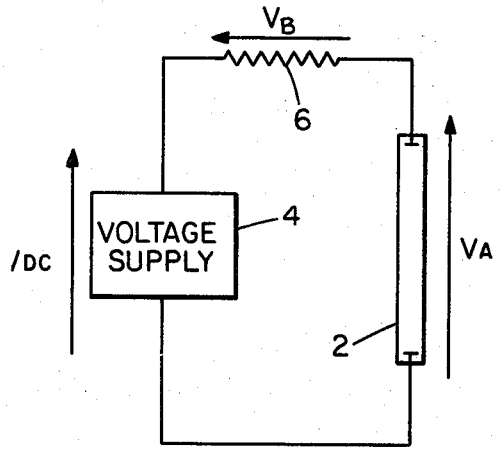
FIG. 1 is a block diagram of a generalized form of the prior art.

In FIG. 1 the prior art is illustrated by a generalized arc device 2 supplied from a D.C. source 4 and connected in series between the two is a ballast 6 in the form of a resistance. In operation the voltage from the source 4 first ionizes the gas in the arc device 2, at which time a current begins to flow which would continue to increase due to the negative resistance characteristic of the device 2 were it not for the current limiting effect of the ballast 6.

Figure 2:
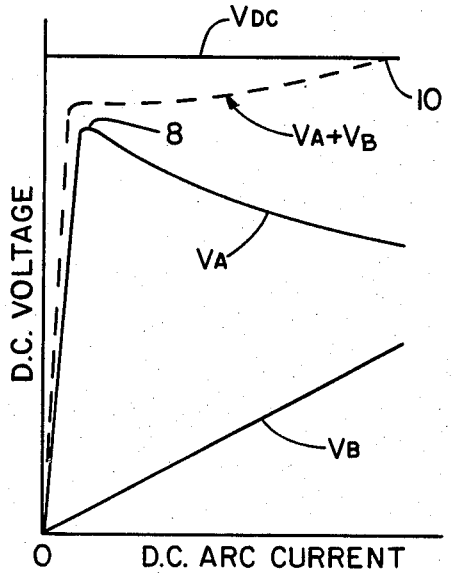
FIG. 2 is a graph illustrating the voltage and current relationships which exist in the power supply ballast circuits of the prior art.

FIG. 2 illustrates graphically the voltage current relationships. Thus, voltage across the arc device increases to a point 8 on the arc voltage curve $V_A$ where ionization occurs. At this point the arc voltage drops; the arc is self-sustaining; current increases and the voltage across the ballast $V_B$ continues to increase. Assuming the resistance of the ballast is properly selected in accordance with the characteristics of the device 2, the combined voltage across the device and the ballast $V_A$ and $V_B$ will approach the value of the supply $V_{DC}$ at 10 and the arc will be stabilized, that is, the current in the arc device will be limited to value sufficient to maintain the arc and will not increase to possibly damage the device.

Figure 3:
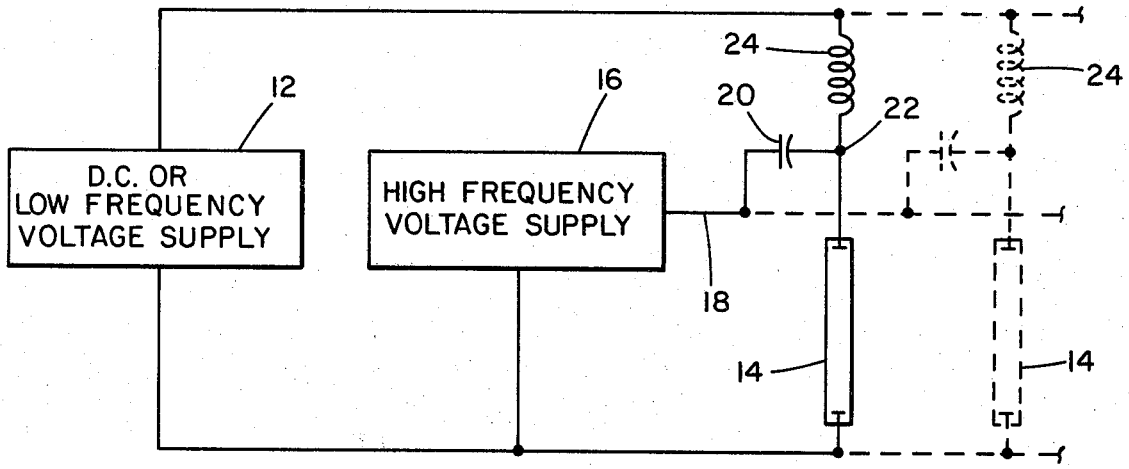
FIG. 3 is a block diagram illustration of one embodiment of the invention.

In accordance with the invention disclosed herein, a power supply for arc discharge devices comprises in part a pair of voltage supplies or sources as shown in FIG. 3. The first of these is a relatively low voltage source 12 which may be either D.C. or low frequency A.C. The low frequency A.C. may be the typical household supply of 60 Hz at 110–120 volts. Connected across the supply are one or more arc discharge devices, such as flourescent lamps 14. A second voltage supply or source 16 is provided with its output 18 connected through a capacitor 20 to the junction 22 of one side of the arc discharge devices and an inductor 24. The second source 16 provides a relatively high frequency, high voltage to the arc discharge device.

Although the second voltage supply is often referred to throughout the application as a relatively high frequency, high voltage supply or a high frequency supply, it should be noted that this supply is not necessarily an A.C. supply. It may be a supply with a D.C. voltage output which has a repetitive wave form. One example of this would be a D.C. pulse wave operating at a higher pulse repetition frequency than the first source. Also, it may be an A.C. wave with a higher frequency than the first source.

In the operation of this circuit the voltage from the source 12 is applied across the inductor 24 and device 14. However, the design parameters are such that the voltage from that source is insufficient to ignite or cause ionization of the gas in the device. However, the voltage from the second source 16 is sufficient to cause ionization, and once that has occurred arc current will be maintained by the voltage from the combined voltages from the sources 12 and 16.

An important advantage of the invention permits a measurable reduction in the size and, therefore, in the cost of the ballast.

This can be appreciated if it is considered first that in accordance with the prior art where the sole source is a D.C. source. In such case the ballast is a resistor which must be of sufficient size to limit the current after ionization to a value which would ensure stable and safe operation of the circuit and device. In accordance with this invention the value of the inductance of the inductor 24 is chosen to provide low losses of the D.C. from the source 12, whereby substantially all of the power from that source is utilized to actually maintain the current in the device. At the same time the inductance is selected to offer a high impedance to the high frequency voltage from the source 16, thereby blocking that source from the D.C. supply.

The capacitor 20 is selected to provide a suitable high frequency ballast impedance if required, or minimum impedance if not required, to the high frequency voltage from the source 16 and at the same time effectively block the D.C. from that source. As the result of this arrangement the losses in the capacitor and inductor are relatively low so that there is an improvement in overall circuit efficiency over the conventional D.C. ballast circuit. In such a conventional circuit the ballast resistance is required to be about equal to the arc resistance whereby it is relatively large and expensive so that overall circuit efficiency is about 50%.

If the source 12 is a relatively low frequency A.C., i.e., a 60 Hz 110–120 volts supply, the inductor 24 is selected to offer a high impedance to the high frequency supply 16, however the low frequency voltage drop and losses are small. At the same time the capacitor 20 blocks the low frequency from the supply 16. In this embodiment of the invention the high and low frequencies should be sufficiently separated to permit the operations described.

Again, if most of the power for the operation of the arc device, after ionization, is derived from the supply 12, and since the losses in the inductor 24 and capacitor 20 are small, a more efficient circuit is provided and the size and weight of the circuit may be reduced from that found in the conventional A.C. ballast circuit.

It is possible, in accordance with the invention, to select the C and L values of the capacitor 20 and inductor 24 to resonate the frequency of source 16, or a multiple thereof, whereby a higher or maximum amount of voltage may be supplied to an arc discharge device 14 during ionization. With such a design it may be possible to reduce the voltage level of the source 16 and still ensure that sufficient ionizing voltage is supplied to the device.

Figure 4:
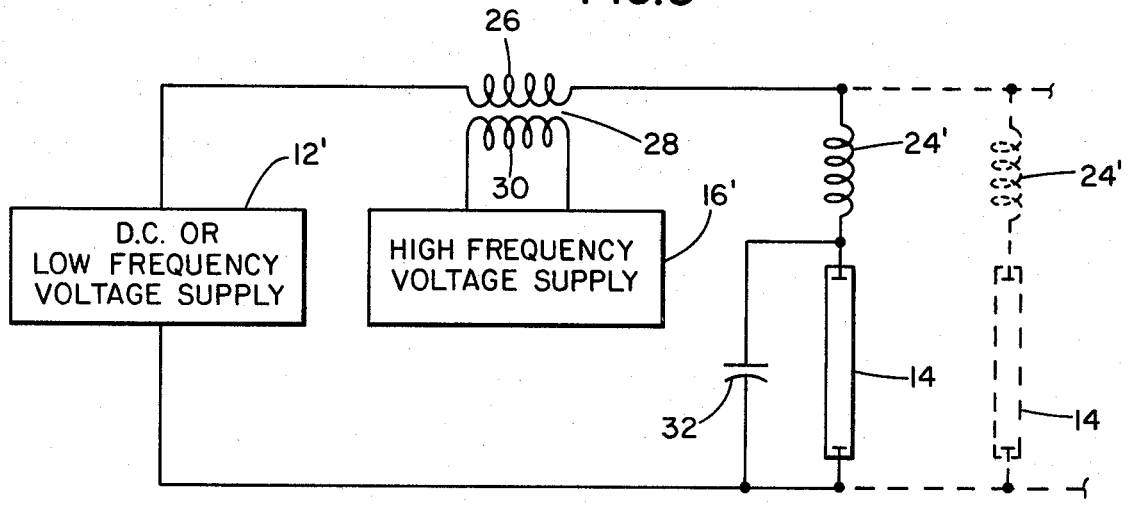
FIG. 4 is a block diagram illustration of an alternative embodiment of the invention.

Another embodiment of the invention is illustrated in FIG. 4. In this embodiment, instead of providing the two power supplies in parallel, as in FIG. 3, they may be connected serially as shown. Thus, a first power supply 12' is connected in series with the secondary 26 of a transformer 28, the primary winding 30 of which supplies the output from the second or high frequency source 16'. In this embodiment, again by sufficiently separating the high and low frequencies, inductor 24' may be selected to provide a suitable ballast impedance, if required, to the high frequency while offering little impedance and consequent losses to the low frequency voltage from the source 12'. Likewise the secondary 26 of the transformer 30 can be selected to offer a low impedance to the source 12'.

The transformer 28 may be eliminated if the high frequency voltage supply has sufficient voltage output and that supply connected directly in the line between the source 12' and inductor 24'. If it is desired to reduce the high frequency current through the source 12' a bypass capacitor or other circuit may be shunted across that source; or, if the high frequency supply is connected directly in the line it may be shunted by a bypass inductor. With only one arc device, the inductor 24' may be deleted.

As before, resonance may be provided in this circuit by connecting a capacitor in shunt across the arc discharge device as shown at 32.

Figure 5:
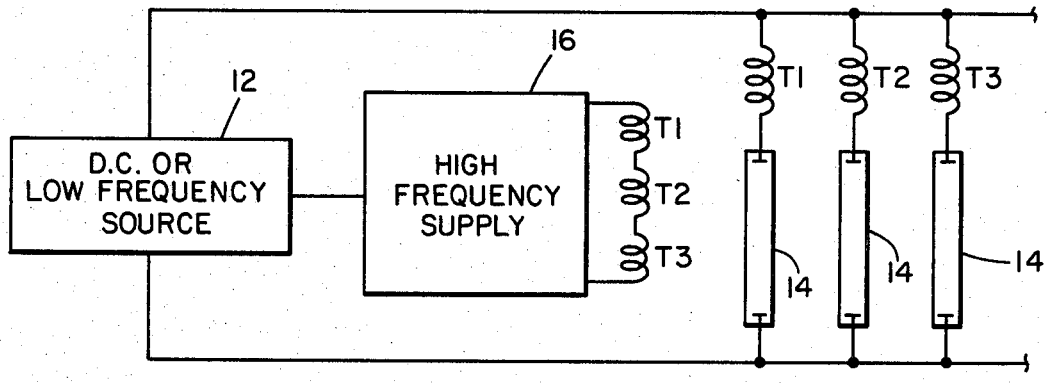
FIG. 5 is a block diagram illustration of another alternative embodiment of the invention.

In another embodiment of the invention, illustrated in FIG. 5, a separate transformer $T_1$, $T_2$ and $T_3$ is provided for a plurality of arc discharge devices and supply the high frequency voltage for ionization in series with the low frequency or D.C. voltage. As before, the low voltage source is indicated by reference numeral 12 and the high voltage source by reference numeral 16.

In this embodiment as with the others, the frequency separation between the two sources is such that the secondary of each of the transformers offers little impedance and low losses to the voltage from the source 12. Each of the arc discharge devices could be ballasted with the high frequency supply by the leakage inductance of the transformer or a ballast inductor in series with the arc device offering little or no impedance to the low voltage supply 12. The primaries of the transformers $T_1$, $T_2$, $T_3$ need not be in series as shown, but, of course, could be connected in parallel.

In order to eliminate all ballasting for the low frequency or D.C. source in the above embodiments, a relationship between the high frequency supply, the magnitude of the low frequency or D.C. voltage, and the arc characteristics must be observed. The high frequency supply should not allow the instantaneous arc current from the low frequency or D.C. to exceed the value of current determined from the arc voltage-current characteristic at the instantaneous arc voltage provided by the low frequency or D.C. source.

In FIG. 5 and the preceding figures only one arc discharge device is shown in each circuit branch. However, two or more such devices may be used in such branch circuit and connected in series with each other.

This may be of particular advantage if the available low frequency or D.C. voltage source is too great a voltage magnitude for the arc device characteristics, as described above.

Figure 6:
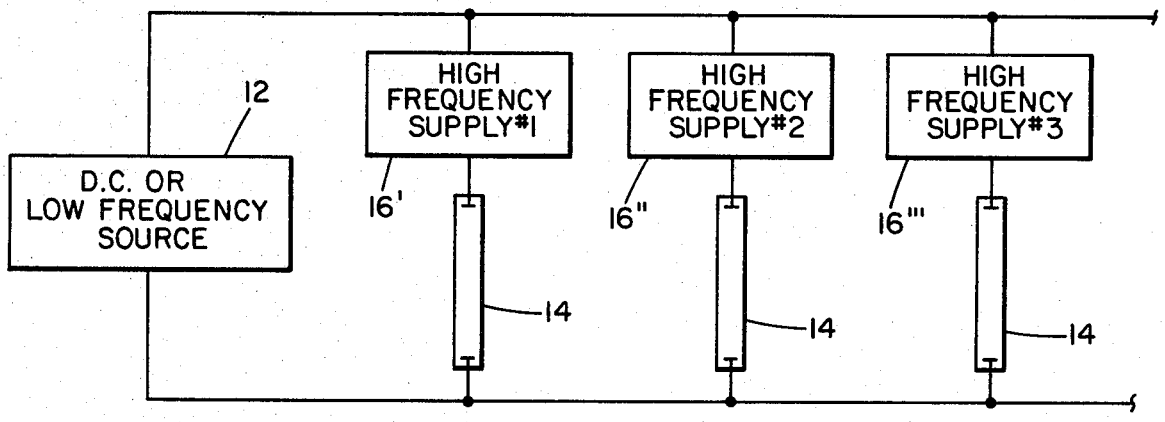
FIG. 6 is a block diagram illustration of still another alternative embodiment of the invention.

Likewise a separate high frequency supply could be provided for each arc discharge device, and that supply connected in series with the device and the low voltage supply. This arrangement is shown in FIG. 6 where the low voltage supply 12 is provided along with high voltage supplies 16', 16'' and 16'''.

As will be described hereinafter, the high frequency supply may be of the type which is supplied with D.C. In such an event circuits, in accordance with the invention, may be easily connected to a battery which, in the event of failure of the low voltage source, would still provide emergency lighting without the necessity of a separate system.

Figure 7:
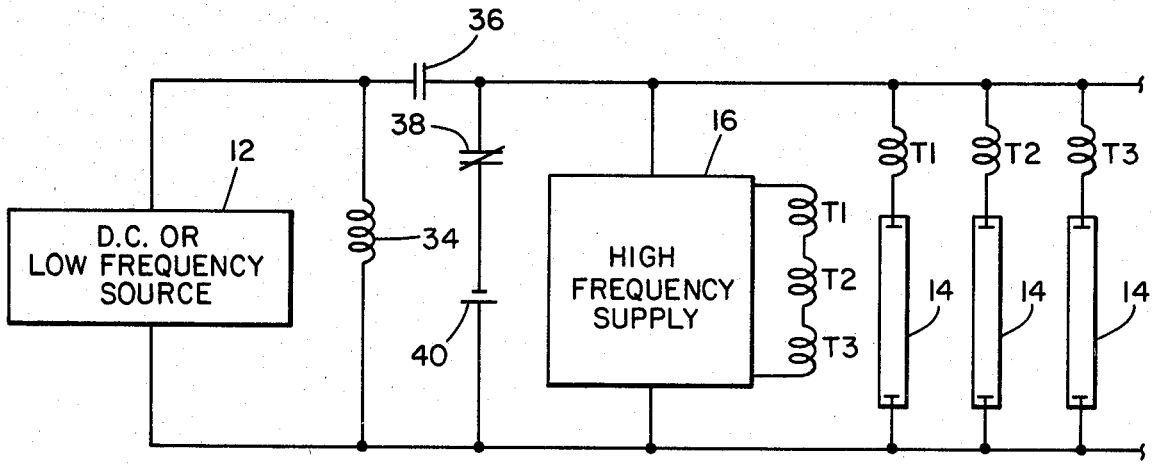
FIG. 7 is a block diagram illustration of an emergency lamp circuit incorporated in an embodiment of the invention.

Such an arrangement is shown in FIG. 7. Where a relay 34 has a normally open contact 36 and a normally closed contact 38. The contact 36 is connected in series between the source 12 and arc discharge devices 14 while the contact 38 is connected across the supply lines in series with a battery 40. During normal operation when voltage is supplied from the source 12 the relay 34 is picked up closing the contact 36 and opening the contact 38 so that power is supplied from the sources 12 and 16 as described previously. In the event of a failure of the source 12 the relay 34 drops out opening the contact 36 and closing the contact 38, whereby the high voltage supply 16 is supplied from the battery 40 and its output is such to light the arc discharge devices (fluorescent lamps) 14. Alternatively, the battery could be connected to the load by means of a solid state switching device effective to connect the battery to the load when the D.C. input voltage is below a predetermined level.

As previously stated, the high frequency, high voltage supply provides the necessary ionization voltage and control of total power. The low frequency (or D.C.) low voltage supply supplies most of the power. This may be seen by an inspection of FIG. 8 which is a drawing of a photograph of the face of an oscilloscope displaying the voltage across and current through a fluorescent tube connected to a circuit constructed in accordance with the invention. The upper curve 100, voltage, shows the 60 Hz supply voltage on which is superimposed the high frequency voltage. The lower curve 102 illustrates the current through the tube and as may be seen shows the combined currents as caused by the high and low frequency voltages of curve 100.

If the early part of the half cycle of the 60 Hz is considered, it may be seen that initially the current through the load 14 (the fluorescent tube) is zero at point 104 when the high frequency supply is turned on and immediately following the voltage is high while current is low. As the high frequency supply continues the voltage decreases while the current increases. When the high frequency supply is cut off at 106 both the high frequency voltage and current decrease to zero. It should be noted that the 60 Hz current does not immediately drop to zero when the high frequency supply is cut off but rather decreases gradually toward the zero value. It is believed that this situation obtains because the energy levels of the gas electrons in the tube are relatively high so there is still some 60 Hz current for a period, but eventually the voltage from the low frequency drops to a value where conduction can no longer be maintained.

Figure 8:
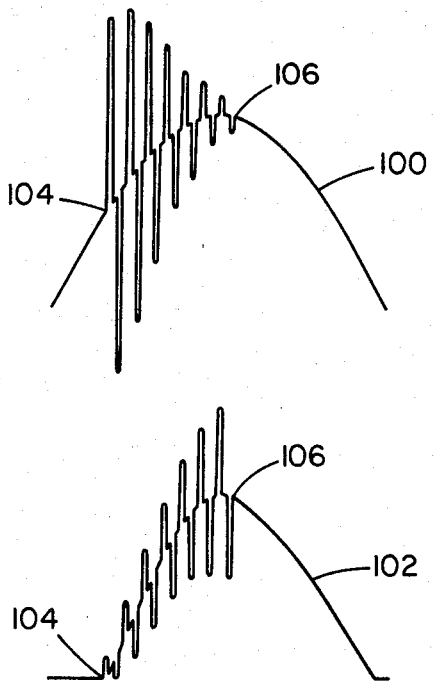
FIG. 8 is a drawing of oscilloscope wave shapes of voltage and current during operation of an embodiment of the invention.

A consideration of the wave forms of FIG. 8 permit two possible conclusions about the operation of the invention. First, since power is equal to $$\frac{1}{T}\int_0^T vi\,dt$$

and the wave forms show a relatively small area (vi) for the high frequency and a relatively large area (vi) for the low frequency it may be deduced that most of the power is supplied by from the 60 Hz source. This has the advantage of minimizing the size, weight, losses and cost of the high frequency supply.

Further, the wave forms suggest a possible explanation of the operation of the circuit. As pointed out, the wave forms show that during the interval the high frequency is being supplied the high frequency voltage while initially high decreases while the high frequency current, initially low increases. If the peak voltage of a high frequency pulse is divided by its corresponding peak current, the result is the resistance of the tube at that point. Thus, the resistance of the tube decreases with each successive high frequency half wave during that interval. Again the explanation could be that as the interval of high frequency proceeds more electrons are brought to higher energy levels and each succeeding high frequency half wave ionizes a greater number of atoms whereby the resistance decreases.

The sigificance of this resistance decrease is that it is applicable to the 60 Hz current. With each high frequency half wave, the arc resistance to the 60 Hz is also lowered and there can be seen an appropriate increase in the 60 Hz current. It would seem the high frequency half wave pulses are controlling the 60 Hz arc current by controlling the resistance of the arc. Since the change in arc resistance can be seen with each successive high frequency half wave, it appears that the high frequency is controlling the arc resistance with little or no time delay. it may now be recognized that the high frequency can virtually instantaneously control the 60 Hz current, i.e., increase or reduce the 60 Hz instantaneous current at any point within the half wave of the 60 Hz voltage.

The high frequency supply can take any number of forms. It could be constituted by rotating machinery, a converter, an oscillator or D.C. pulse generator. Such devices are well known in the art. For instance, suitable solid state circuits may be found in the SCR Manual, 4th Edition, published by the General Electric Company, 1967, particularly in Chapter 11 thereof. Many of these will continuously conduct current in the arc device.

Figure 9:
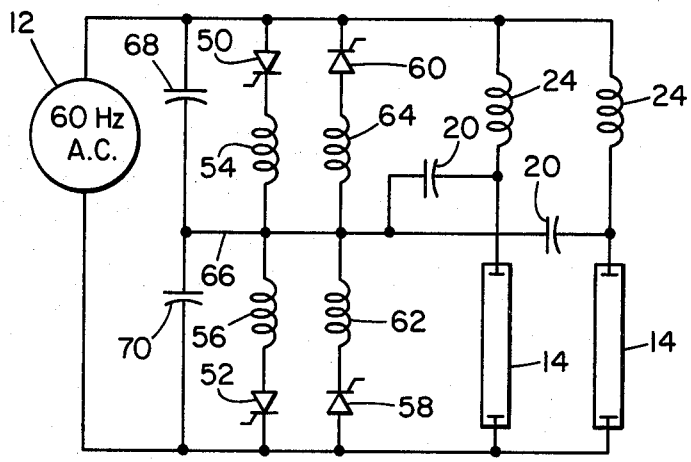
FIG. 9 is an illustration of a circuit which may be used as a high frequency supply 16 forming a part of the invention.
Figure 10:
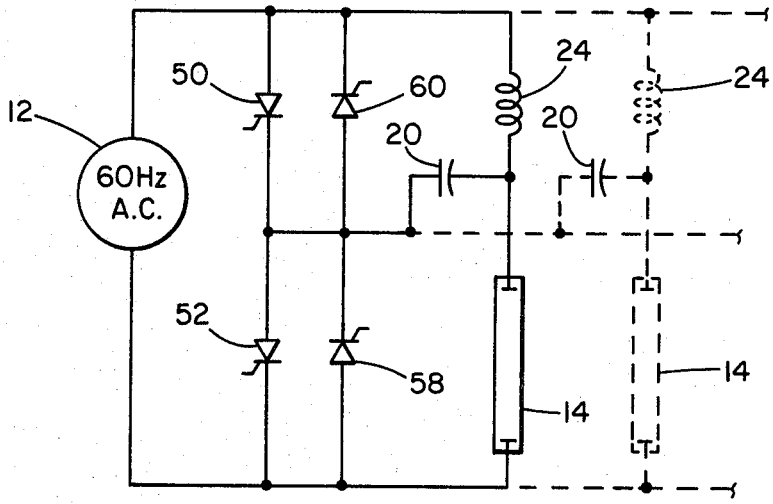
FIG. 10 is an illustration of the circuit showing an alternative embodiment of the high frequency supply useful with the invention.
Figure 11:
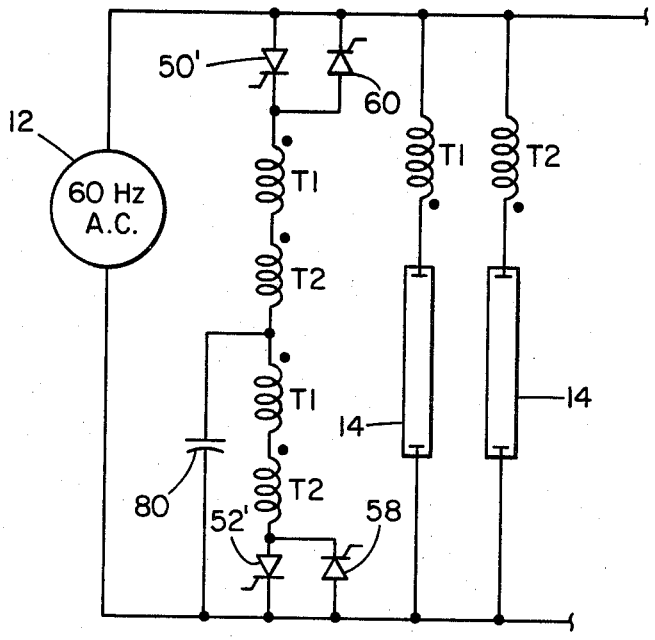
FIG. 11 is another illustration of the high frequency supply useful with the invention.

FIGS. 9, 10 and 11 described below are particularly suitable as a high frequency supply since they can operate directly from the low frequency A.C. power source without an A.C. to D.C. power supply.

The supply in FIG. 9 comprises a pair of SCR's 50 and 52 connected in series with each other and a pair of inductors 54 and 56 across the A.C. line. Connected in parallel are a pair of oppositely poled SCR's 58 and 60 which are likewise in series with each other and inductors 62 and 64. A bus 66 connects the junctions of the inductors 54 and 56 and inductors 62 and 64 to the output capacitors 20. Resonant circuits are completed by capacitors 68 and 70 connected between the bus 64 and the A.C. line. In this circuit the SCR's 54 and 52 are triggered when the top A.C. line is positive and the circuit then functions in the manner of a D.C. inverter such as shown on pages 156–161 of the SCR Manual, Third Edition, published by General Electric Company, 1964, except that the supply voltage is not fixed but varies as a sine wave because of the nature of the supply. The SCR's 58 and 60 are triggered when the top A.C. line is negative and the circuit operates in the same way, only in the opposite direction. As may be seen each capacitor 20 and arc discharge device 14 is in parallel with the inverter capacitor 70, and as the voltage across that capacitor changes during the high frequency charge and discharge that change is supplied through the capacitors 20 to the device 14.

In FIG. 9, a D.C. source may be used instead of the 60 Hz A.C. shown by deleting 58, 60, 62 and 64 and connecting the positive D.C. to the top power line. This would provide A.C. from the high frequency supply.

In FIG. 10 a circuit is shown whereby the coupling capacitor 20 and inductor 24 also constitute the resonant circuit discharged by the conduction of the SCR's, thereby eliminating the necessity for the inductors 54, 56, 64, 62 and capacitors 78 and 70 shown in FIG. 9.

In FIG. 11 the output of the high frequency supply consists of the transformers $T_1$ and $T_2$. The transformers are wound to have the polarity indicated by the dots shown in association with their primary windings and secondary windings. In this case primaries constitute the "L" of the resonant circuit discharged by the SCR's while a capacitor 80 constitutes the "C" of such a circuit. When the top line of the A.C. is positive, SCR 50′ is triggered to provide a resonant charge of the capacitor 80 through the top transformer primaries $T_1$ and $T_2$. A short time later the SCR 52′ is triggered and the capacitor 80 is discharged through the bottom transformer primary windings $T_1$ and $T_2$ again in the same direction, that is toward the bottom line of the A.C. supply. As may be seen, the secondaries of the transformers are wound so as to make the high frequency voltage and current additive to the low frequency voltage and current.

In FIG. 11, a D.C. source may be used instead of the 60 Hz A.C. shown by deleting SCR's 58 and 60. With the positive D.C. connected to the top power line, the high frequency supply would provide D.C. pulses additive to the D.C. power source.

In the circuits described, since they are resonant, the period of the high frequency half wave is fixed. However, the duration and trigger frequency may be controlled within the 60 Hz half wave to obtain a more useful control of the low frequency current.

Figure 12:
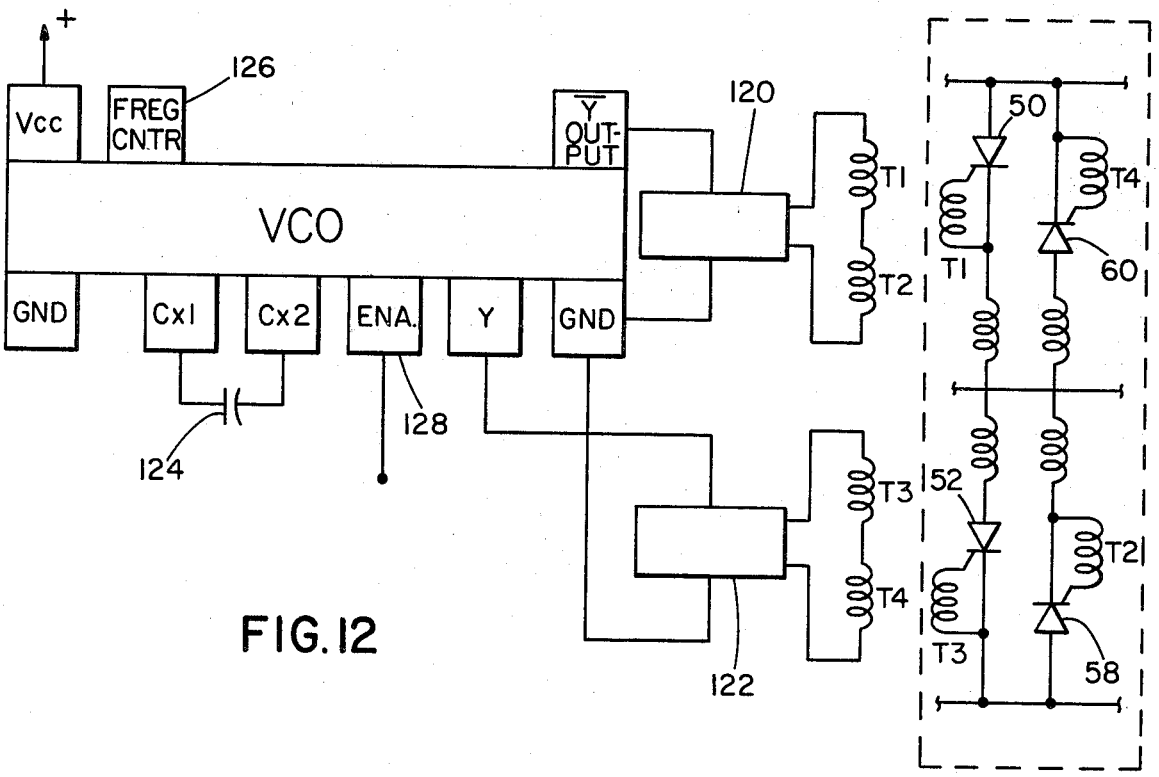
FIG. 12 is an illustration of a trigger circuit for the high frequency supply of FIG. 9, and which may be adapted for FIGS. 10 and 11.

A suitable method of triggering for FIG. 9, and which may be adapted to FIGS. 10 and 11, is shown in FIG. 12, and will be used to explain additional aspects of the invention, that is, how the high frequency may control the arc current. The four SCR's are triggered by a voltage-controlled oscillator (VCO) such as the Texas Instruments Integrated Circuit Part Number SN 54LS324, specifications are given on page 7-445 of the TTL Data Book for Design Engineers published by Texas Instruments, Inc. in 1976. Referring to FIG. 12, there are outputs identified as $\overline{Y}$ and Y. $\overline{Y}$ is connected by an amplifier 120 to SCR's 50 and 58 through transformers Tand $T_2$, and Y is connected by an amplifier 122 to SCR's 52 and 60 through transformers $T_3$ and $T_4$.

A capacitor 124 connected between CX1–CX2 sets the initial frequency of the oscillator while the frequency control 126 changes that frequency by a change in the input voltage, i.e., the output trigger frequency varies proportionally with the input voltage. This output frequency, and consequently the high frequency supply, may be turned on and off by a low or high voltage, respectively, on the enable pin 128.

For first mode of operation the frequency control has constant input voltage resulting in a constant trigger frequency to the SCR's. The enable input 128 may then be turned on and off within the half wave of the 60 Hz to control arc intensity. Referring to FIG. 8, the high frequency supply is turned on at 104 and off at 106, the interval between 104 and 106 is referred to as duration. Control of an arc intensity or dimming in an arc lamp may be provided in several ways by changing the duration. In FIG. 8, the wave forms are shown at rated light output. Point 106 could be fixed and point 104 could be delayed by a manual dimming control which decreases the duration and light output. Point 104 could be fixed and point 106 advanced by a manual dimming control, again shortening the duration. Or, point 104 could be delayed and point 106 could be advanced simultaneously by a manual control.

For a second mode of operation both points 104 and 106 are fixed, i.e., a constant duration. By a manual dimming control on the input voltage to the frequency control 126 of the VCO, the voltage can be reduced thereby reducing the trigger frequency which causes less 60 Hz arc current and dimming can be accomplished.

In a third mode of operation the duration is fixed. A varying voltage wave is repeated each half wave of the 60 Hz and provided to the frequency control 126 which causes the trigger frequency to be changed within the half cycle of the 60 Hz. By changing the trigger frequency within the half cycle, the 60 Hz current wave may be shaped. FIG. 8 shows a wave shape resulting from a constant frequency throughout the duration between point 104 and point 106, and will be used for illustration. A higher frequency from the high frequency supply increases the instantaneous 60 Hz current and a lower frequency reduces the instantaneous 60 Hz current. By applying a higher frequency at the beginning of the duration shown in FIG. 8, the 60 Hz current will build up more rapidly than shown. Then the higher frequency is gradually decreased until there is a lower frequency than FIG. 8 around the peak of the 60 Hz voltage half wave resulting in less 60 Hz arc current than shown in FIG. 8, and then the frequency is gradually increased to be higher than FIG. 8 at the ending of the duration. This frequency pattern within the 60 Hz half cycle will produce a wave shape with higher 60 Hz arc current at the beginning and ending and lower 60 Hz arc current in the middle of the 60 Hz half wave than FIG. 8, assuming the same RMS power for both arc current waves. It may be seen that different voltage waves to the frequency control will produce different arc current wave shapes and the arc current wave may be shaped for various purposes, such as reducing the EMI or to reduce or eliminate the high frequency ballast.

The low frequency ballast has already been eliminated as previously explained, however some impedance may be used or required to ballast the high frequency supply in certain circuits. By properly selecting the pattern of variable voltage to be repeated into the frequency control each 60 Hz half wave in a manner to provide the arc device with a variable frequency pattern that is matched to its arc voltage-current characteristics, the high frequency ballast may be reduced or even eliminated.

Although all of the circuits above use SCR's as the switching device, transistors may be used to accomplish the same result by one skilled in the state of the art.

Throughout the patent application the terms "power source" or "source" or "power supply" or "supply" have been used interchangeably.

As pointed out, the high frequency supply can take any number of forms and utilize circuits for such purposes which are well known in the art. If solid state circuits are used for this purpose the triggering for such circuits may likewise be provided by circuits which are well known in the art. Changes and modifications beyond those shown or suggested herein may be provided, and it is intended by the claims appended hereto and forming a part of this specification to cover all such changes and modifications as come within their scope.

What is claimed as new and desired to be secured by Letters Patent is:

1. A power supply circuit for arc discharge devices including a first relatively low voltage source having means for connection to an arc discharge device and continuously supplying voltage at a level insufficient to conduct current in an arc discharge device until ionization has occurred in the device and having a power capability whereby it supplies a significant portion of the power to the device, and a second relatively high voltage power source having means for connection to the arc discharge device and continuously supplying voltage at a level sufficient to cause ionization in the device.

2. A power supply circuit as set forth in claim 1 wherein the first source is D.C. and the second source is A.C.

3. A power supply circuit as set forth in claim 1 wherein the first source is A.C. and the second source is A.C. of a higher frequency.

4. A power supply circuit as set forth in claim 1 wherein the first source is D.C. and the second source is a D.C. repetitive wave form.

5. A power supply circuit as set forth in claim 1 wherein the first source is A.C. and the second source is a D.C. repetitive wave form of a higher frequency including means to reverse the polarity of the second source with each half cycle of the first source.

6. A power supply circuit as set forth in claim 1, including means for controlling the initiation and/or termination of said second source.

7. A power supply circuit as set forth in claim 6 wherein said means for controlling the initiation of said second source includes for delaying and/or advancing such initiations and/or terminations for adjustable time intervals after the initiation of said first source.

8. A power supply circuit as set forth in claim 1, including means for isolating the outputs of each source from the other source.

9. A power supply circuit as set forth in claim 8 wherein said first source is isolated from said second power supply by an inductor connected between their outputs providing a high impedance to the output of said second source, and wherein said first source is isolated from said power supply by a capacitor providing a high impedance to the output of said first source.

10. A power supply circuit as set forth in claim 1 wherein the output of said second source is coupled to the arc discharge device by a capacitor.

11. A power supply circuit as set forth in claim 10, including a plurality of capacitors and arc devices.

12. A power supply circuit as set forth in claim 1 wherein the output of said second source is coupled to an arc discharge device through transforming means.

13. A power supply circuit as set forth in claim 1, including means for controlling the duration of the output of said second source.

14. A power supply circuit as set forth in claim 1, including means for adjusting the frequency of said second source.

15. A power supply circuit as set forth in claim 1, including means for providing a varying frequency from said second source.

16. A power supply circuit as set forth in claim 15 with means for adjusting the varying frequency of said second source.

17. A power supply circuit as set forth in claim 15, including means of controlling the duration of the output of said second source.

18. A power supply circuit as set forth in claim 1, including means for varying the voltage amplitude of said second source.

19. A power supply circuit as set forth in claim 1, including means of varying the pulse width of the said second source.

20. A power supply circuit as set forth in claim 1, including means for connection to more than one arc discharge device.

21. A power supply circuit as set forth in claim 1, including switch means normally connecting said second source to an A.C. line and operative in the event the termination of voltage in the A.C. line to connect said second power supply to an alternative power source.

22. A power control circuit comprising an arc discharge device having a pair of spaced electrodes, a first relatively low voltage source connected to said arc discharge device and continuously supplying voltage at a level insufficient to conduct current in said device until ionization has occured and having a power output capability whereby it supplies a significant portion of the power to said device, and a second relatively high voltage power source having means for connection to the arc discharge device and continuously supplying voltage at a level sufficient to cause ionization in the device.

23. A power supply circuit for arc discharge devices including a first relatively low voltage source having means for connection to an arc discharge device and continuously supplying voltage at a level insufficient to conduct current in an arc discharge device until ionization has occurred in the device and having a power capability whereby it supplies a significant portion of the power to the device, a second relatively high voltage A.C. power source having means for connection to the arc discharge device and continuously supplying voltage at a level sufficient to cause ionization in the device, and wherein said last mentioned means comprises circuit elements selected to resonate at the frequency of said second source.

24. A circuit for turning on a discharge lamp means and maintaining said discharge lamp means on for a selected period, said discharge lamp means having a characteristic negative impedance, the improvement comprising: means for supplying a low frequency alternating current voltage commensurate with commercial power amplitude whereby it supplies a significant portion of the power to the discharge lamp and frequency values; means for applying the alternating current voltage from said first mentioned means across the discharge lamp; oscillator means for generating a high frequency alternating current voltage; means for superposing said high frequency alternating current voltage on said low frequency alternating current voltage across the discharge lamp during the entire on period of the discharge lamp, the duration of the on period being shorter than a half period of the low frequency alternating current voltage; and impedance means connected between said first supplying mentioned means and the discharge lamp for blocking high frequency voltages but passing the low frequency alternating current voltage of said first supplying mentioned means to the discharge lamp whereby the discharge lamp is maintained on by the superposed alternating current voltages of said first supplying mentioned means and said oscillator means.

* * * * *